US008290409B2

(12) United States Patent
Stelter et al.

(10) Patent No.: US 8,290,409 B2
(45) **Date of Patent: *Oct. 16, 2012**

(54) DEVELOPER STATION FOR AN ELECTROGRAPHIC PRINTER HAVING REDUCED DEVELOPER AGITATION

(75) Inventors: Eric C. Stelter, Pittsford, NY (US); James D. Shifley, Spencerport, NY (US); Joseph E. Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 572 days.

This patent is subject to a terminal disclaimer.

(21) Appl. No.: 12/415,380

(22) Filed: Mar. 31, 2009

(65) Prior Publication Data

US 2010/0247162 A1 Sep. 30, 2010

(51) Int. Cl.
*G03G 15/09* (2006.01)

(52) U.S. Cl. ..... 399/272; 399/267; 399/269

(58) Field of Classification Search ..... 399/265, 399/267, 269, 272, 275, 276, 277, 282
See application file for complete search history.

(56) References Cited

U.S. PATENT DOCUMENTS

| | | | | |
|---|---|---|---|---|
| 4,570,570 | A * | 2/1986 | Masham | 399/267 |
| 4,714,046 | A | 12/1987 | Steele et al. | |
| 5,768,661 | A * | 6/1998 | Coffey et al. | |
| 6,035,168 | A * | 3/2000 | Masuda et al. | 399/272 |
| 6,764,798 | B2 | 7/2004 | Yamazaki et al. | |
| 6,861,190 | B2 | 3/2005 | Yamazaki et al. | |
| 6,875,550 | B2 | 4/2005 | Miyakawa et al. | |
| 6,916,586 | B2 | 7/2005 | Ishiyama et al. | |
| 6,994,942 | B2 | 2/2006 | Miyakawa et al. | |
| 7,011,920 | B2 | 3/2006 | Nagai et al. | |
| 7,022,447 | B2 | 4/2006 | Miyakawa | |
| 7,142,791 | B2 | 11/2006 | Yuge | |
| 7,190,928 | B2 | 3/2007 | Miyakawa et al. | |
| 7,235,337 | B2 | 6/2007 | Kameyama et al. | |
| 7,343,120 | B2 | 3/2008 | Slattery et al. | |
| 7,343,121 | B2 | 3/2008 | Slattery et al. | |
| 7,348,120 | B2 | 3/2008 | Eida et al. | |
| 7,426,361 | B2 | 9/2008 | Thompson et al. | |
| 7,481,884 | B2 | 1/2009 | Stelter et al. | |
| 2004/0114969 | A1 | 6/2004 | Manno | |
| 2009/0154961 | A1 * | 6/2009 | Kamiya et al. | 399/275 |

FOREIGN PATENT DOCUMENTS

| | | | |
|---|---|---|---|
| JP | 57 190974 A | | 11/1982 |
| JP | 04034580 A | * | 2/1992 |
| JP | 2004 205648 A | | 7/2004 |
| JP | 2005 274924 A | | 10/2005 |

* cited by examiner

*Primary Examiner* — Susan Lee
(74) *Attorney, Agent, or Firm* — Donna P. Suchy

(57) ABSTRACT

A developer station and method for an electrographic printer is provided that reduces developer agitation. The developer station includes a sump of magnetic developer, and a magnetic brush roller mounted above sump and having a rotatable magnetic core surrounded by a substantially cylindrical toning shell rotatably mounted with respect to the core. The toning shell defines a nip at its closest point to the photoconductor element. A tangent line tangent to the cylindrical toning shell at the nip is oriented substantially vertically, and the magnetic developer is applied to the toning shell at an angular distance of no more than about 120° from the nip. The toning shell may be eccentrically mounted with respect to the magnetic core and is substantially closest to the rotatable magnetic core within about +30° and −30° from the nip. Such a configuration advantageously reduces the residence time of the developer on the toning shell.

25 Claims, 7 Drawing Sheets

DEVELOPER STATION FOR AN ELECTROGRAPHIC PRINTER HAVING REDUCED DEVELOPER AGITATION

CROSS REFERENCE TO RELATED APPLICATIONS

This application relates to commonly assigned, copending U.S. application Ser. No. 12/415,439, filed Mar. 31, 2009, entitled: "DEVELOPER STATION WITH AUGER SYSTEM", U.S. application Ser. No. 12/415,476, filed Mar. 31, 2009, entitled: "DEVELOPER STATION FOR AN ELECTROGRAPHIC PRINTER WITH MAGNETICALLY ENABLED DEVELOPER REMOVAL" and U.S. application Ser. No. 12/415,508, filed Mar. 31, 2009, entitled: "DEVELOPER STATION WITH TAPERED AUGER SYSTEM."

FIELD OF THE INVENTION

This invention generally relates to electrographic printers, and is particularly concerned with a developer station and method that reduces the agitation of a magnetic developer conveyed from a sump to a photoconductor member by a rotating magnetic brush.

BACKGROUND OF THE INVENTION

Electrographic printers that use a rotating magnetic brush to apply a dry, particulate developer to a photoconductor member are known in the art. In such electrographic printers, the rotating magnetic brush includes a rotatable magnetic core surrounded by a rotatable, cylindrical toning shell that is eccentrically mounted with respect to the axis of rotation of the magnetic core. The magnetic brush is mounted adjacent to a developer sump that holds a reservoir of dry, two-component developer including a mixture of ferromagnetic carrier particles and toner particles capable of holding an electrostatic charge. The eccentric mounting of the toning shell defines an area of relatively strong magnetic flux where the shell comes closest to the magnetic core, and an area of relatively weak magnetic flux 180° opposite to the area of strongest magnetic flux where the shell is farthest away from the core. The area of strongest magnetic flux also contains a line of closest approach between the toning shell of the magnetic brush and the photoconductor member. This line of closest approach defines a "nip" between these two components where the particulate toner component of the developer is transferred to the photoconductor member as a result of electrostatic attraction between the toner particles and the electrostatic field from the photoconductor member. The combination of the magnetic brush and the developer sump is referred to as the developer station in this application.

In operation, the photoconductive member is moved past a pre-cleaner and a cleaning station to remove any residual toner that might be on the surface of the member after the previous image transfer. A corona charger then imparts a uniform static charge on to the surface of the member. The photoconductive member is next moved past an image writing station (which may include an LED bar) that writes a latent, electrostatic image on the member by exposing it to a pattern of light. Next, the exposed photoconductor member is moved past the developer station, where the magnetic brush develops the latent electrostatic image on the member by continuously applying a uniform layer of developer at the nip between the toning shell and the photoconductor member. At the nip, toner particles in the developer are transferred to the photoconductor member in a pattern commensurate with the electrostatic image on the member. The developed image on the photoconductor member is then transferred to, for example, an intermediate transfer web for subsequent transfer to a final receiver. The developer that remains on the toning shell downstream of the nip is removed by a skive and deposited back in the developer sump. The used, toner-depleted developer is replenished as needed with additional toner particles in the sump. Replenished developer is continuously applied downstream of the skive far from the toning nip at or near the area of weakest magnetic flux on the toning shell of the magnetic brush, where it is moved back toward the area of strongest magnetic flux and the nip.

In color printing, a series of electrographic printers arranged in tandem are used to create image separations in different primary colors (i.e. cyan, magenta, yellow, and black) which are superimposed over one another to create a final color image. To this end, each printer prints its particular primary color image on an intermediate transfer web which resembles a conveyor belt. The conveyor-belt movement of the intermediate transfer belt is synchronized with the printing by the photoconductor members of the in tandem printers such that the images are superimposed in alignment with one another, creating a final color image.

It is highly desirable for the intermediate transfer web to be horizontally oriented so the height of the resulting color printing assembly is less than a standard room ceiling height. As a consequence, the intermediate transfer web should engage the photoconductor element of each printer at either the 6 o'clock position in a "process-over-image" configuration, or in a 12 o'clock position in an "image-over-process" configuration. As a further consequence, the nip between the toning shell and the photoconductor member should be located at one or the other of the sides of the photoconductor member, preferably near the 9 o'clock or 3 o'clock position.

It is further desirable to use a photoconductor that is as small in diameter as possible to reduce cost and overall printer size. The pre-clean, clean, charge, expose, develop, and transfer stations must all be positioned adjacent to the photoconductor member. If a small photoconductor member is used, all of these systems must also be as small as possible so as not to interfere with each other or the intermediate transfer web, yet still produce adequate images. Hence there are limitations on, in particular, the height of developer station positioned at the 9 o'clock or 3 o'clock position relative to the photoconductor member.

It is also desirable to print images as quickly as possible, requiring faster printer speeds. The combination of small size and high process speed is technologically demanding. From a fundamental point of view, large fluxes of charge, light, or particles are needed due to the high rates required for the short time allowed for each process step. This means in general that, as speed is increased and size is decreased, larger concentrations, intensities, and driving forces are used.

Faster printing can be accomplished by increasing the rotational speed of the magnetic brush. However, the inventors have observed that increasing the rotational speed of the magnetic core can produce undesirable effects, such as embedment of toner and heating of carrier particles that ages the developer. Also, increasing the rotational speed of the magnetic core can cause toner particles to fracture and produce small particles, or fines. To fully appreciate the first-mentioned problem, some explanation of the constitution of the toner particles is in order.

A widely practiced method of improving the transfer of the toner particles is by use of so-called surface treatments. Such surface treated toner particles have adhered to their surfaces sub-micron particles, e.g., of silica, alumina, titania, and the like (so-called surface additives or surface additive particles). Surface treated toners generally have weaker adhesion to a smooth surface than untreated toners, and therefore surface treated toners can be electrostatically transferred more efficiently from a photoconductor member to another member. Such surface treated toners also advantageously maintain the same amount of electrostatic attractive force with respect to the photoconductor member despite variations in the ambient humidity.

In particular, the inventors have observed that, when the rotational speed of the rotating magnetic core is increased beyond a certain limit, the carrier particles become excessively heated as a result of hysteresis of the magnetization of the carrier particles caused by the rapidly changing magnetic field of the rotating core. The resulting heat is transferred from the carrier particles to the toner particles, which in turn softens them. The rapidly changing magnetic field of the rotating core also creates excessive mechanical agitation in the toner. The resulting heating, softening, and mechanical impact between the carrier particles and the toner particles causes the sub-micron surface-treatment particles of silica, alumina, titania, and the like to embed into the toner particles, thereby diminishing the ability of the toner particles to hold the static charges necessary for reliable and consistent transfer to the photoconductor member.

SUMMARY OF THE INVENTION

The invention is a developer station and method for an electrographic printer that reduces developer agitation during the printing process. The developer station comprises a sump for holding a reservoir of magnetic developer, and a magnetic brush roller mounted above said sump that includes a rotatable magnetic core surrounded by a substantially cylindrical toning shell rotatably mounted with respect to the core. The toning shell is adjacent to the photoconductor element (which may be drum shaped) such that a nip is defined between the shell and the element. A tangent line tangent to the cylindrical toning shell at the nip is preferably oriented within a range of between about +45° and −45° with respect to a vertical line, and more preferably oriented within a range of between about +10° and −10°. Additionally, the magnetic developer is applied to the toning shell at an angular distance of no more than about 120° from the nip, and preferably no more than about 90° from the nip.

Such a configuration allows the developer station to be positioned adjacent to the photoconductor element at either a 9 o'clock or 3 o'clock position, and hence may be used in a printer module of a color printer in which color images are superimposed on a horizontally oriented intermediate transfer web to create a final color image. Such a configuration further substantially reduces the residence time the developer spends on the magnetic brush, thereby allowing increased printing speeds without the aforementioned toner embedment or fine generation problems. Finally, such a configuration may be implemented in a manner that provides a relatively short vertical height to the resulting developer station, which in turn allows the use of a small-diameter photoconductor member.

The developer station may include a single conveyor roller to move developer from the sump to the toning roller. The developer station may also include a pair of horizontally-spaced conveyor rollers to achieve a low vertical profile. Finally, the developer station may include no conveyor rollers. In such an embodiment, the toning shell may directly contact the reservoir of developer in the sump. All of these arrangements provide a developer station capable of applying developer to a relatively small-diameter photoconductor member at either the 9 o'clock or 3 o'clock position without mechanical interference with a horizontally oriented intermediate transfer web.

In the method of the invention, when a relatively high speed printing operation is carried out such that magnetic carrier particles on the toning shell are subjected to at least about 190 pole flips per second as a result of relative rotation between the magnetic core and the toning shell, developer is delivered to the toning shell at an angular distance no more than about 120° from the tangent line between the toning shell and the photoconductor member to reduce the residence time that the developer stays on the developer shell prior to transfer of toner particles from the toning shell to the photoconductor element.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1A:
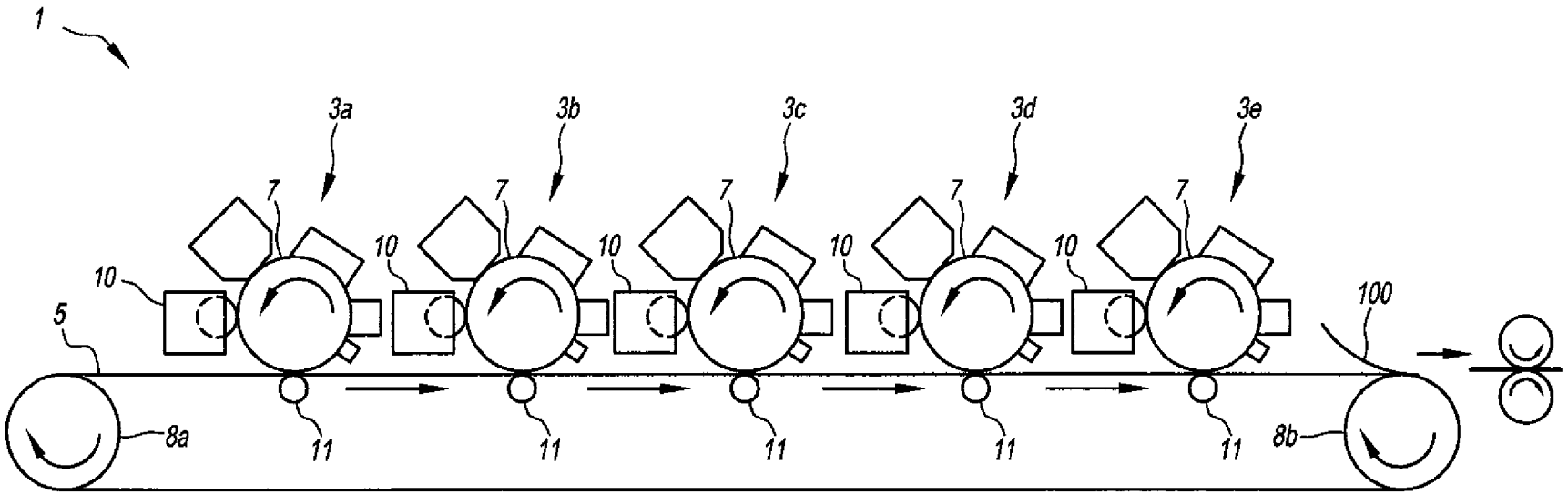
FIG. 1A is a schematic side view of a typical electrographic printing assembly in process-over-image configuration suitable for use with the developer station of the invention.
Figure 1B:
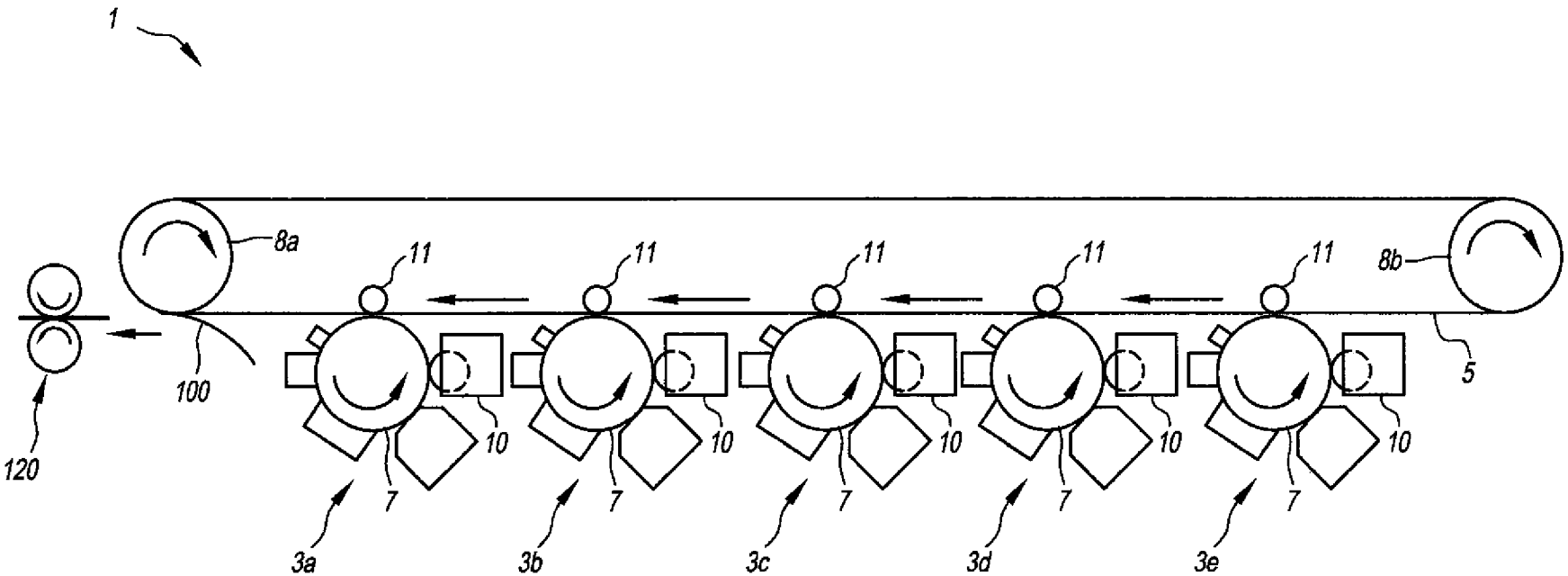
FIG. 1B is a schematic side view of a typical electrographic printing assembly in image-over-process configuration suitable for use with the developer station of the invention.

With reference to FIG. 1A, an electrographic printing apparatus 1 has a number of tandemly arranged electrostatographic image-forming printers in the form of printer modules 3*a*, 3*b*, 3*c*, 3*d*, and 3*e*. Each of the printer modules 3*a*-3*e* is disposed over a horizontally-oriented intermediate transfer web 5 in process-over-image configuration, although the invention is equally applicable to a printing apparatus 1 wherein the intermediate transfer web is disposed above the printer modules 3*a*-3*e* in image-over-process configuration, as shown in FIG. 1B. Each printer module 3*a*-3*e* includes a photoconductor element which may take the form of a photoconductor drum 7. In FIG. 1A, the top portion of the intermediate transfer web 5 is moved from left to right by rollers 8*a*, 8*b* in conveyor-belt fashion immediately beneath the photoconductor drum 7 of each printer modules 3*a*-3*e* while the photoconductor drums rotate counterclockwise at the same speed. Each of the printer modules 3*a*-3*d* includes a developer station 10 that develops a single-color toner image such as black (K), cyan (C), magenta (M), or yellow (Y) onto the photoconductor drum 7. Printer module 2*e* may include an additional color toner or a clear toner for transfer of clear images to the intermediate transfer web 5. A backer bar 11 having an electrostatic voltage transfers the toner image off of the drum 7 of each of the printer modules 3*a*-3*e* and onto the web 5. In operation, the intermediate transfer web 5 is first passed through module 3*a*, where it receives a first toner image. Subsequent toner images are superimposed in registry with this first toner image as it passes through printer modules 3*b*-3*e* in order to form a single pentachrome image, and one clear toner image. The single pentachrome image is ultimately transferred to a receiver such as a sheet of paper 100 and then fused into a permanent color image in a fuser assembly 120 in a manner well-known in the art.

In FIG. 1B, for the image-over-process configuration, the bottom portion of the intermediate transfer web 5 is moved from right to left by rollers 8*a*, 8*b* in conveyor-belt fashion immediately above the photoconductor drum 7 of each printer modules 3*a*-3*e* while the photoconductor drums 7 rotate counterclockwise at the same speed. For the image-over-process configuration shown in FIG. 1B, each of the printer modules 3*a*-3*d* perform the same functions as for the process-over-image configuration shown in FIG. 1A.

Figure 2:
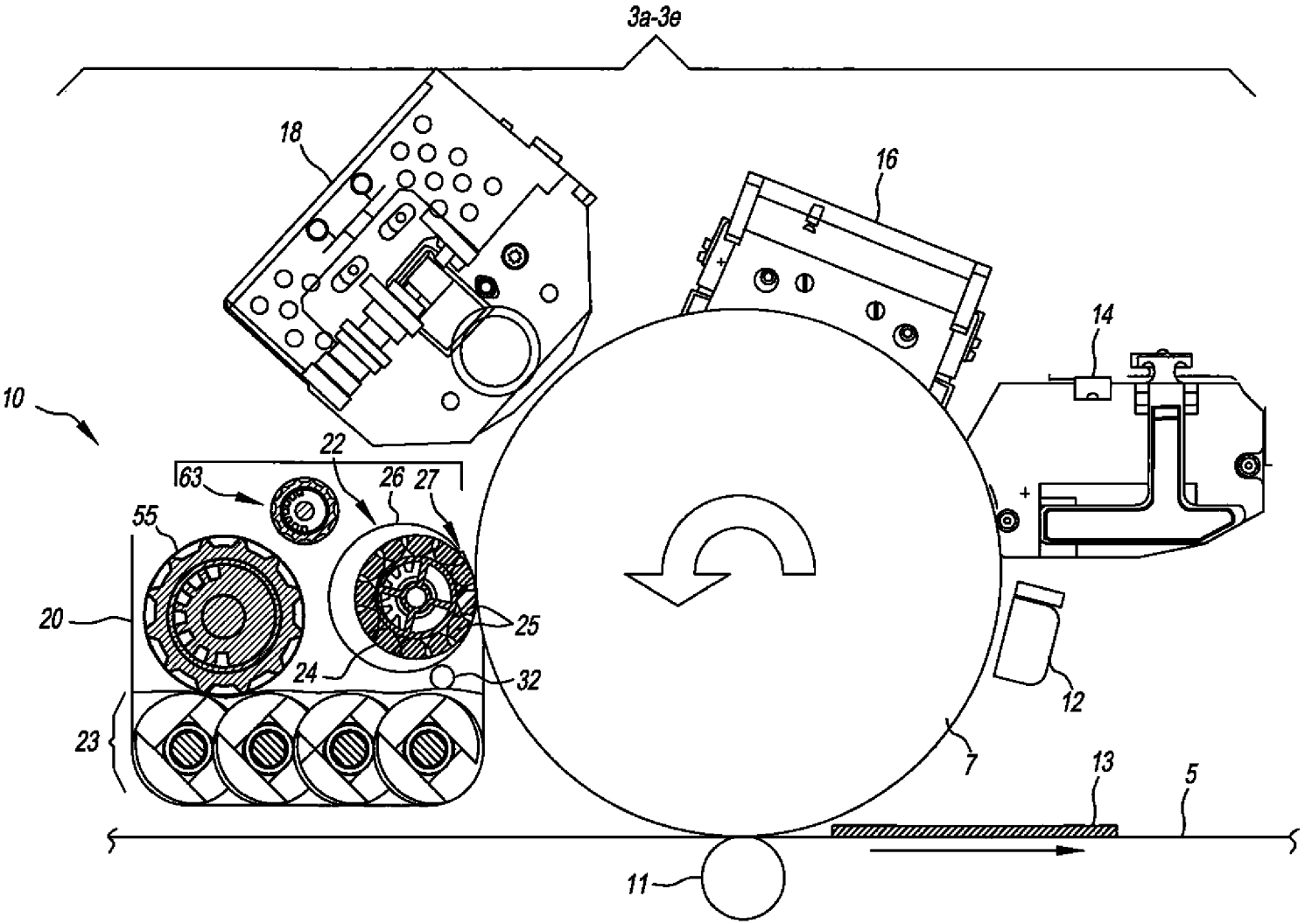
FIG. 2 is a side view, in partial cross section, of one of the printing modules used in the printing assembly of FIG. 1A, on an enlarged scale.

With reference now to FIG. 2, each of the printer modules 3*a*-3*e* includes a pre-cleaner unit 12 having a corona charger and a lamp for recharging, exposing and discharging residual electrostatic charge on the photoconductor drum 7 that remains after the transfer of the toner image 13 onto the web 5. Such electrostatic neutralizing of the drum 7 facilitates the removal of residual toner particles by the toner cleaner 14 located downstream of the pre-cleaner unit. A corona charger 16 is located downstream of the toner cleaner 14. Charger 16 imparts a negative charge of between about 600 and 700 volts to the surface of the photoconductor drum 7. An optical image writer 18 is located downstream of the corona charger 16. Writer 18 includes a digitally-controlled LED bar that exposes the surface of the photoconductor drum 7 to a modulated light signal, which in turn selectively discharges portions of the charged surface of the photoconductor drum such that a latent electrostatic image is written across the surface of the photoconductor drum 7.

Figure 3A:
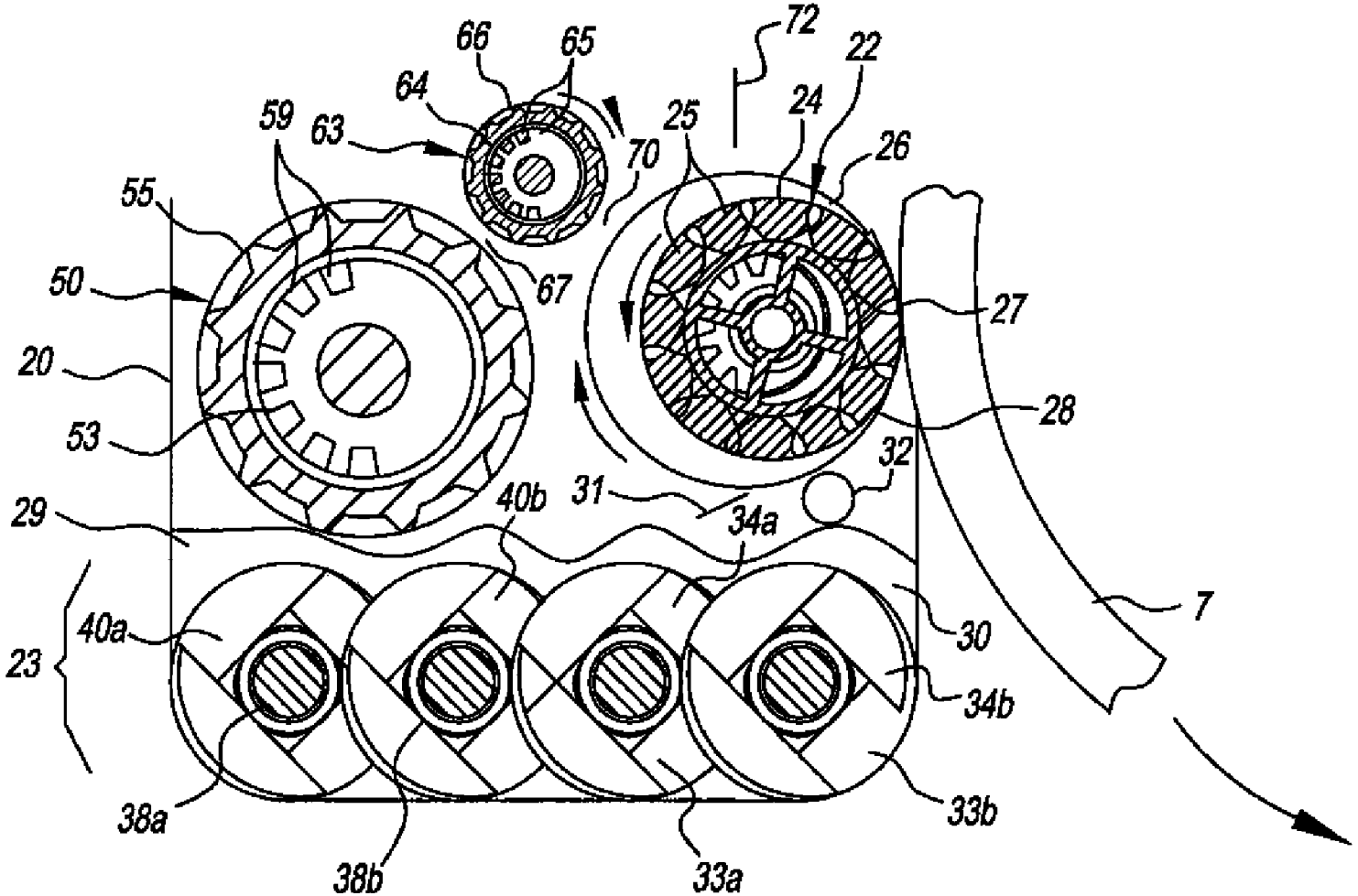
FIG. 3A is a cross sectional side view of a first embodiment of the developer station of the invention which may be used in the printing module illustrated in FIG. 2 and which employs two conveyor rollers.

With reference now to FIGS. 2 and 3A, the developer station 10 includes a housing 20, a magnetic brush 22, and a developer sump 23. The magnetic brush 22 is also known as the combination of the developer and the toning roller. The toning roller includes a magnetic core 24 having a plurality of magnets 25 arranged around its outer periphery and a toning shell. The core 24 is rotatably mounted with respect to the housing 20. While not expressly shown, the north-south magnetic axes of the magnets are radially-oriented with respect to the cylindrically-shaped core 24, and the magnets 25 are arranged with alternating north and south magnetic poles around the outer periphery of the core 24 such that "U" shaped lines of magnetic flux interconnect adjacent magnets. The magnetic core 24 is surrounded by a rotatably mounted, cylindrically shaped toning shell 26. Toning shell 26 may be eccentrically mounted with respect to the magnetic core as shown. The axes of rotation of the toning shell 26 and the photoconductor drum 7 are parallel as indicated, and a first nip 27 is defined at the line of closest approach between the cylindrically-shaped toning shell 26 and the photoconductor drum 7. The axes of rotation of the magnetic core 24 and the toning shell 26 are also parallel, and the line of closest approach between these two components defines the location 28 where the magnetic field on the toning shell 26 is generally greatest in magnitude.

With reference to FIG. 3A, the sump 23 contains a reservoir 29 of two-component developer 30 formed from a dry mixture of magnetic carrier particles and toner particles. Preferably, the carrier particles are hard magnetic ferrite particles having high coercivity. The carrier particles may have a volume-weighted diameter of approximately 26 mu.m. The dry toner particles are preferably substantially smaller, (on the order of 6.mu.m to 15.mu.m in volume-weighted diameter). The toner particles are removed from the carrier particles during the development operation that occurs at the nip 27 between the toning shell 26 and the photoconductor drum 7. The toner particles are polymeric or resin-based, and are electrostatically chargeable. The toner particles are created by blending various components, which can include binders, resins, pigments, fillers, and additives, for example, and processing the components by heating and milling, for example, whereupon a homogeneous mass is dispensed by an extruder. The mass is then cooled, crushed into small chips or lumps, and then ground into a powder. As previously mentioned, a widely practiced method of improving the transfer of the toner particles is by use of so-called surface treatments. Such surface treated toner particles have adhered to their surfaces sub-micron particles, e.g., of silica, alumina, titania, and the like which in turn improves the electrostatic properties of the toner particles.

The sump 23 of the developer station 10 functions to continuously provide a supply of developer 30 to the toning shell 26 of the magnetic brush 22 having a correct proportion of toner particles relative to magnetic carrier particles. As is well known in the art, when developer 30 is used to develop a latent electrostatic image on the photoconductor drum 7, the toner particles in the developer are electrostatically transported from the toning shell 26 to the drum 7, while the magnetic carrier particles remain on the toning shell 26. These remaining magnetic carrier particles and unused developer are removed from the toning shell by a skive 31 and are redeposited back into the right-hand side of the reservoir 29 of developer 30. In order to maintain a correct proportion of carrier and toner particles in the developer conveyed to the toning shell 26, a toner replenisher tube 32 conveys toner particles to the right-hand side of the developer reservoir 29 as needed. Sump 23 further includes a pair of return augers 33*a*, 33*b* having left-handed screw blades 34*a*, 34*b* for simultaneously conveying the developer particles stripped away from the developing shell 26 by the skive 31 and the toner particles added by the replenisher tube 32 (along with other developer in the sump 23) to a front mixing chamber (not shown) 35 where flippers on the return augers 33*a*, 33*b* mix the carrier particles and toner particles to form a replenished developer which is conveyed from the front mixing chamber to feed augers 38*a*, 38*b*. The feed augers 38*a*, 38*b* have left-handed screw blades 40*a*, 40*b* which convey the replenished toner down the length of the sump 23. Flippers at the rear ends of feed augers 38*a* and 38*b* (not shown) convey the developer to return augers 33*a* and 33*b*. In this example of the invention, the return augers 33*a*, 33*b* turn counterclockwise while the feed augers 38*a*, 38*b* turn clockwise, thereby causing the developer to circulate around the sump 23 in a clockwise direction when viewed from above.

With reference again to FIG. 3A, the developer station 10 further includes first and second conveyor rollers 50, 63 for conveying developer to the toning shell 26. Conveyor rollers are also referred to as transport rollers. The first conveyor roller 50 includes a stationary magnetic core 53 surrounded by a rotatable cylindrical shell 55. The rotatable shell 55 of the roller 50 is located above the feed augers 38*a*, 38*b* adjacent with the developer 30 in the reservoir 29 so that it can pick up developer material. The magnetic core 53 preferably a plurality of magnets 59 for conveying the developer over the 12 o'clock position of the roller 50. As was the case with the magnets 25 in the core 24 of the magnetic brush 22, all of the magnets 59 of the first conveyor roller are arranged to present alternating north and south magnetic poles around the circumference of the rotating shell 55 that are magnetically linked by U-shaped flux lines. The cylindrical shell 55 rotates clockwise and carries developer to the second conveyor roller 63.

The second conveyor roller 63 likewise includes a fixed magnetic core 64 having a plurality of magnets 65 that is surrounded by a rotatable cylindrical conveyor shell 66. Like the shell 55, the shell 66 also rotates clockwise. The magnets 65 of the second conveyor roller produce a magnetic field at the nip 67 between rollers 50 and 63 such that developer is transferred from roller 50 to roller 63 at the nip 67 between the rollers. The clockwise rotation of both of the rollers 50, 63 causes the developer to make a U-shaped turn at the nip 67 as it is transferred to the second roller 63. As a result of its continued clockwise rotation after receiving developer from the first conveyor roller 50, the second conveyor roller 63 delivers developer to the toning shell 26 at the nip 70. Here, the developer makes another U-shaped turn and travels over the upper portion of the toning shell 26 through a metering skive 72 and into the nip 27 between the shell 26 and the photoconductor drum 7.

Figure 3B:
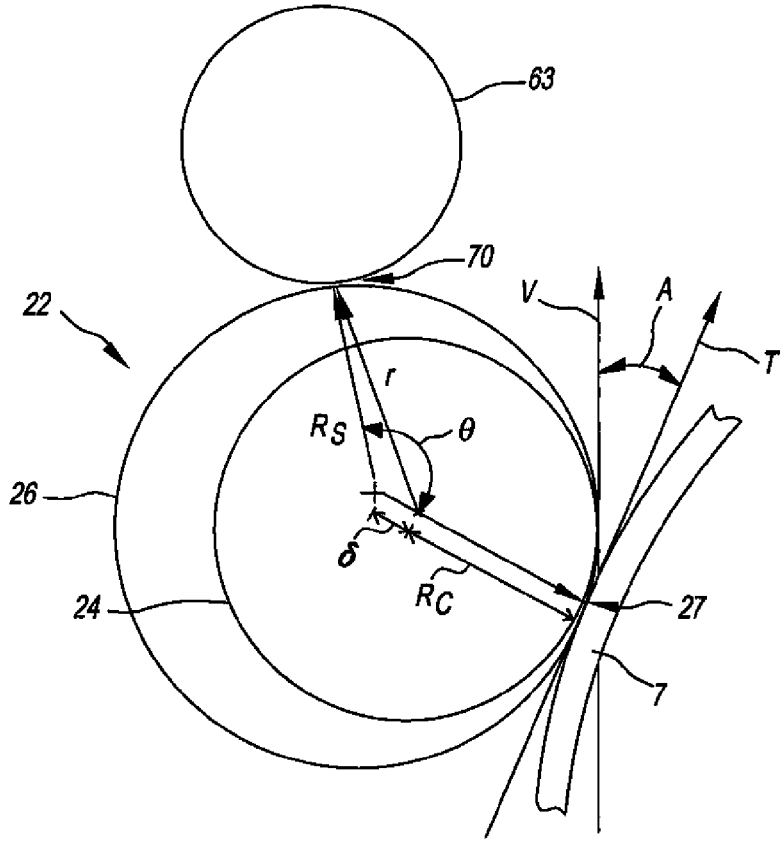
FIG. 3B is a schematic view of the magnetic brush, photoconductor drum and second conveyor roller of the developer station of FIG. 3A, illustrating the angular relationship between the delivery point of the developer on the toning shell of the magnetic brush and the nip between the toning shell and the photoconductor drum.
Figure 3C:
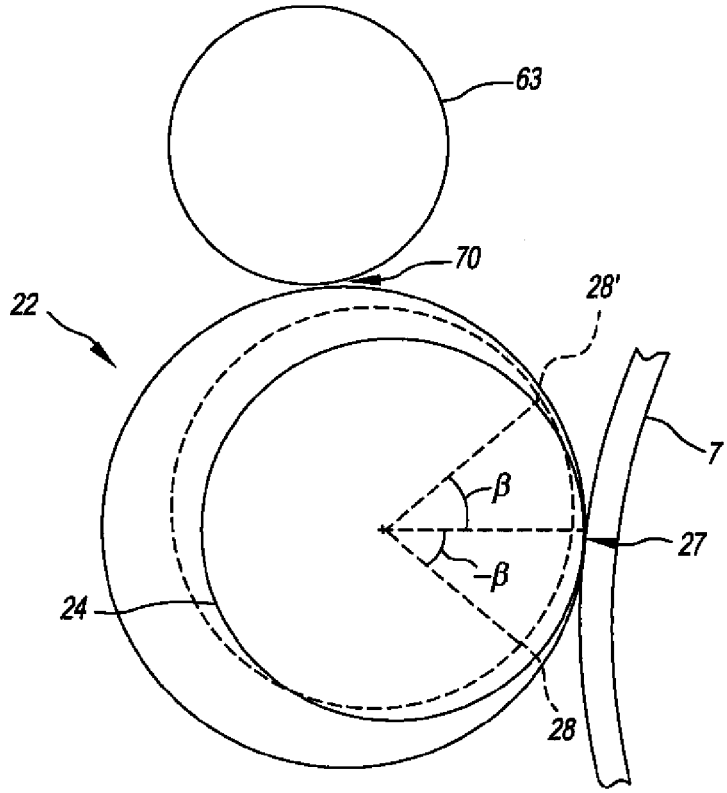
FIG. 3C is a schematic view of the magnetic brush, photoconductor drum and second conveyor roller of the developer station of FIG. 3A, illustrating the angular relationship between the nip between the toning shell and the photoconductor drum and the closest line between the toning shell and the rotating magnetic core of the magnetic brush.

FIG. 3B illustrates the preferred orientation of a tangent line T that is tangent to the nip 27 between the toning shell 26 and the photoconductor drum 7 with respect to a vertical axis V. Preferably, the line T is oriented at an angle A between about +45° and −45° with respect to vertical axis V. In FIG. 3B, this angle is about +20° and the toning shell 26 is illustrated as contacting the photoconductor drum 7 at about the 10 o'clock position. Angle A would be −20° if the toning shell were illustrated as contacting the photoconductor drum at the 8 o'clock position. More preferably, the angle that the tangent line T makes with the vertical axis V is preferably between about +10° and −10°. Most preferably, the tangent line T is substantially aligned with the vertical axis V, as is shown in FIG. 3C. Such a tangent line orientation allows the developer station 10 to be positioned at one of the sides of the photoconductor drum.

FIG. 3B also illustrates the preferred angular distance θ between the developer delivery point on the toning shell (which in this embodiment corresponds to the nip 70) and the nip 27 between the toning shell 26 and the photoconductor drum 7 which is preferably less than 120°. Even more preferably, this angular distance θ is 100°. Most preferably, this angular distance θ is 90°. Such an arrangement shortens the residence time of the developer on the toning shell 26, which advantageously reduces both the amount of hysteresis-generated heating of the magnetic carrier particles (which in turn heats the fusible toner particles), as well as the mechanical agitation of the mixture of carrier and toner particles. The lower amount of heating and agitation advantageously avoids embedment of the surface treatments applied to the toner particles, which in turn allows them to maintain their enhanced ability for efficient transport between the toning shell and the photoconductive drum. The lower amount of agitation also reduces the generation of fines and undesirable "dusting" of the toner as it is conveyed by the toning shell 26. Dusting refers to a smoke-like, uncontrolled release of toner particles from the magnetic carrier particles prior to the arrival of the developer at the nip 27. Such dusting can cause an unwanted toner deposition in the light portions of the printed image. In this particular embodiment of the invention, the relatively short angular distance θ is achieved by the use of a second conveyor roller 63 having horizontal and vertical components of spacing with respect to the first roller 50 such that the developer is applied above the center line of the toning shell 26. It should further be noted that the use of two conveyor rollers 50, 63 having a horizontal component of spacing provides the developer station 10 with a relatively short height dimension, which allows it to be positioned adjacent to a side of the photoconductor 7 without mechanical interference with the intermediate transfer web 5 or other components of the printer module.

FIG. 3C illustrates the preferred angular distance p between the line of closest approach 28 of the rotating magnetic core 24 and the toning shell 26 of the magnetic brush 22, and the nip 27 of the toning shell 26 and the photoconductor drum 7. In all embodiments of the developer station of the invention, angle β is preferably less than between about +30° and −30°. More preferably, angle β is less than between about +10° and −10°. Most preferably, angle β is about 0° such that the nip 27 and the line 28 are horizontally aligned with one another. Such an alignment positions the strongest portion of the magnetic field of the brush 22 at the nip 27 which helps to secure the carrier particles onto the toning shell 26 during toner development, and further positions the weakest part of the magnetic field of the brush 22 on the portion of the toning shell facing away from the photoconductor drum 7, thereby facilitating the removal of residual carrier particles on the shell 26 by skiving.

The operation of the developer station 10 will now be described with reference to FIGS. 3A, 3B, and 3C. The shells 55 and 66 of the first and second conveyor rollers 50, 63 rotate clockwise around their stationary magnetic cores 53 and 64. The magnets 59 in the core 53 of the first conveyor roller 50 attract developer 30 from the reservoir 29 onto the shell 55. The rotating shell 55 conveys this developer 30 to the rotating shell 66 of the second conveyor roller 63. The developer 30 is transferred to the rotating conveyor shell 66 of the second conveyor roller 63 at the nip 67 between the first and second conveyor rollers due to the magnetic field of the magnets 65 in the magnetic core 64 of the second conveyor roller 63. At the nip 67, the layer of developer makes a U-shaped turn as it moves from the first to the second conveyor roller, and continues to move over the top of the second conveyor roller 63. The layer of developer next makes a second U-shaped turn at the nip 70 between the second conveyor roller 63 and the toning shell 26 of the magnetic brush 22 as a result of the greater magnetic strength of the rotating magnetic core 24, where it is transferred to the toning shell 26. As a result of the clockwise rotation of the toning shell 26, the layer of developer 30 is conveyed under a metering skive 72 as insurance against non-uniformities in thickness in route to the nip 27 between the toning shell 26 and the photoconductor drum 7.

In a typical printer module printing 70 pages per minute (PPM), the toning shell 26 may rotate clockwise at 82 rpm while the magnetic core rotates counterclockwise at 800 rpm. While such operational speeds allow a high rate of toner image developing on the photoconductor drum 7, they also create substantial developer agitation and hysteresis-induced heating due to the rapid rate of magnetic flux changes the hard magnetic carrier particles are subjected to as a result of the rotating magnets 25 in the core 24. As described in detail with respect to FIG. 3B, such agitation and heating are substantially reduced by reducing the angular distance between the nip 70 and nip 27 to less than 120° to reduce the residence time of the developer 30 on the toning shell 26. In this first embodiment of the developer station 10 of the invention, such a relatively small angular distance θ is achieved in a station having a magnetic brush capable of applying developer on a photoconductor drum 7 at a 9 o'clock or 3 o'clock position by the horizontally and vertically spaced apart conveyor rollers 50 and 63.

Figure 4:
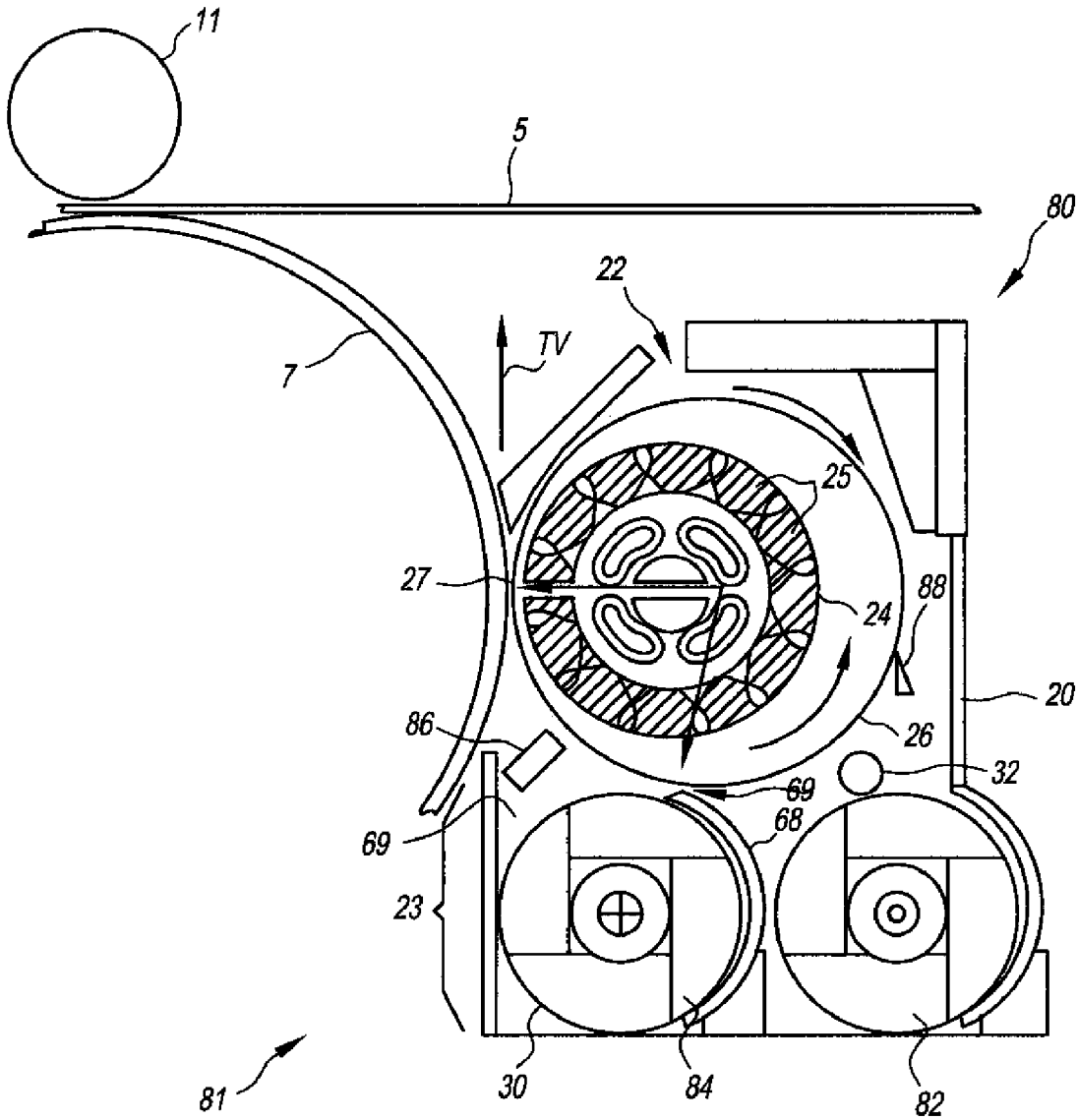
FIG. 4 is a cross sectional side view of second embodiment of the developer station of the invention which does not employ any conveyor rollers.

FIG. 4 illustrates a second embodiment 80 of the developer station of the invention in use in a printer module 81 arranged in an image-over-process configuration as shown in FIG. 1B where the intermediate transfer web contacts the photoconductor drum 7 at the 12 o'clock position. The cleaners 13, 14, charger 16, and writer 18 surrounding the photoconductor drum 7 are not shown for simplicity. In this embodiment, no conveyor rollers are used to transport developer to the toning shell 26 of the magnetic brush 22. Instead, a lower portion of the toning shell 26 directly contacts developer 30 at the developer reservoir 26 contained within the sump 23. A layer of developer is acquired onto the surface of the toning shell at nip 70 adjacent feed auger 84 and is transported in a clockwise direction through a metering skive 86. The resulting trimmed layer of developer then proceeds into the nip 27 between the toning shell 26 and the photoconductor drum 7. The residual magnetic carrier particles which remain on the toning shell 26 after the transfer of the toner particles at the nip 27 are in turn removed by stripping skive 88 located close to 180° away from the nip 27, where they are deposited over a return auger 82. Return auger 82 mixes the residual magnetic carrier particles removed by the skive 88 with fresh toner particles received from the toner replenisher tube 32, and conveys the reconstituted developer to a feed auger 84. While not shown in detail in FIG. 4, the return and feed augers 82, 84 operate in essentially the same way as the augers 33*a*, 33*b* and 38*a*, 38*b* described with respect to the first embodiment.

In the FIG. 4 embodiment 80 of the developer station, the direct engagement between the toning shell 26 and the developer 30 in the reservoir 29 advantageously allows the angular distance θ to be shortened to about 80°, thereby substantially reducing the residence time of the developer on the toning shell 26 over the prior art. Moreover, the tangent line T at the nip 27 between the toning shell 26 and photoconductor drum 7 is substantially aligned with the vertical axis such that this embodiment may be easily arranged into either a 3 o'clock position as shown or a 9 o'clock position with respect to the photoconductor drum 7.

Figure 5:
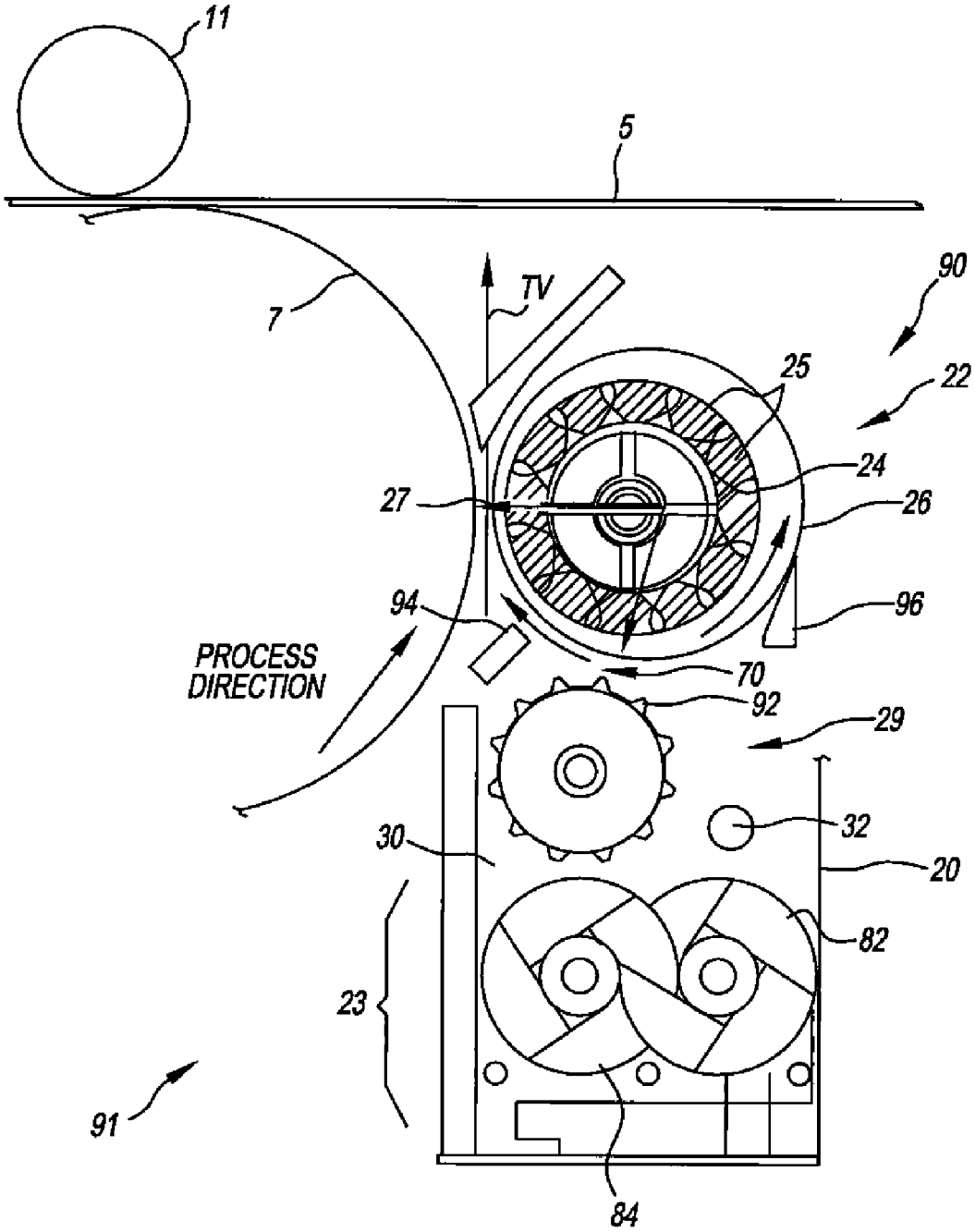
FIG. 5 is a cross sectional side view of third embodiment of the developer station of the invention which employs a single conveyor roller.

Finally, FIG. 5 illustrates a third embodiment 90 of the developer station of the invention in use in a printer module 91 again arranged in an image-over-process configuration as shown in FIG. 1B where the intermediate transfer web 5 contacts the photoconductor drum 7 at the 12 o'clock position. Again, the cleaners 13, 14, charger 16, and writer 18 surrounding the photoconductor drum 7 are not shown for simplicity. In this embodiment, a single, conveyor roller 92 is used to transport developer 30 to the toning shell 26 of the magnetic brush 22 from the reservoir 29 of the sump 23 to the nip 70. This conveyor roller can be a magnetic roller similar to rollers 55 or 63 of FIG. 2 and FIG. 3A, or it can be a mechanical paddle-type roller as is known in the art. Skives 94 and 96 operate in the same manner described with respect to the skives 86 and 88 of the FIG. 4 embodiment 80. In this embodiment 90 of the developer station, the positioning of the single conveyor roller 92 toward the photoconductor drum 7 and between the toning shell 26 and the developer 30 in the reservoir 29 advantageously allows the angular distance θ to be shortened to about 80°, thereby substantially reducing the residence time of the developer on the toning shell 26 over the prior art. Again, the tangent line T at the nip 27 between the toning shell 26 and photoconductor drum 7 is substantially aligned with the vertical axis such that this embodiment may be easily arranged into either a 3 o'clock position as shown or a 9 o'clock position with respect to the photoconductor drum 7.

As mentioned previously, it is desirable to print at high process speeds. The usefulness of the invention as described and also as shown in FIGS. 2 to FIG. 5 can be explained by application of the following examples from U.S. Pat. No. 6,959,162 (also assigned to Eastman Kodak Company of Rochester, N.Y., the entire text of which is hereby expressly incorporated herein by reference) for process speeds ranging from 17.49 inches per second, the equivalent of 110 PPM, to 33.39 inches per second, the equivalent of 210 PPM, and extrapolation to faster speeds. The speed of the developer on the toning shell 26 can be estimated to be approximately equal to the process speed. For example, at 110 PPM or 17.49 inches per second process speed, magnetic core speeds for the magnetic brush 22 of approximately 877 RPM are used, corresponding to 205 pole flips per second for a 14 pole magnetic core. A toning shell speed of 125.5 RPM is used, corresponding for a 2 inch diameter shell to surface speeds of approximately 13.14 inches per second. The developer velocity on the toning shell is approximately 17.49 inches per second. For higher process speeds, the core speed and toning shell speed can be increased proportionally to the process speed. For example, at 150 PPM corresponding to a process speed of 23.85 inches per second, a core speed of 1196.5 RPM can be used, corresponding to approximately 279 pole flips per second, and a toning shell speed of 171.14 RPM is used, corresponding to approximately 17.92 inches per second surface speed. At 220 PPM or a process speed of 34.98 inches per second, a core speed of 1754 RPM can be used, corresponding to approximately 409 pole flips per second, and a toning shell speed of 251 RPM can be used, corresponding to approximately 26.28 inches per second surface speed.

The rate of kinetic energy generated per second contributing to embedment, dusting, and generation of fines is proportional to the square of the number of pole flips per second. For example, a printer that is producing images at 220 PPM will have 4 times the power contributing to embedment and the other problems mentioned than a 110 PPM printer. At a given process speed, the total amount of kinetic energy generated in the developer between transfer of the developer to the toning shell and the toning nip is proportional to the angle θ. For example, at a given process speed, a developer that is transferred to the toning shell within 90 degrees of the development nip will be exposed to only half the kinetic energy resulting from pole flips by the time it reaches the development nip as a developer that is transferred to the toning shell 180 degrees from the nip.

Heat generation in units of power or energy per unit time in the developer due to magnetic hysteresis in the carrier particles during magnetic pole flips is proportional to the number of pole flips per second of the development system. The total amount of heat generated is proportional to the distance traveled on the toning shell. For example, a printer that is producing images at 220 PPM will generate heat due to magnetic hysteresis at approximately 2 times the rate of a 110 PPM printer. The total amount of energy resulting from hysteresis is proportional to the distance traveled on the toning shell by the developer. For example, at a given process speed, a developer that is transferred to the toning shell within 90 degrees of the development nip will be exposed to only half the energy resulting from hysteresis by the time it reaches the development nip as a developer that is transferred to the toning roller 180 degrees from the nip.

In this application, the term "electrographic printer" is intended to encompass electrophotographic printers and copiers that employ dry toner developed on any type of electrophotographic receiver element (which may be a photoconductive drum or belt), as well as ionographic printers and copiers that do not rely upon an electrophotographic receiver.

The invention has been described in detail with particular reference to certain preferred embodiments thereof, but it will be understood that variations and modifications can be effected within the spirit and scope of the invention.

PARTS LIST

1) printing apparatus
3) printer modules a-e
5) intermediate transfer web
7) photoconductor element
8) web rollers
10) developer station
11) charged back-up bar
12) pre-cleaner
13) toner image
14) cleaning brush
16) corona charger
18) optical image writer
20) housing
22) magnetic brush
23) sump
24) rotatable magnetic core
25) magnets
26) toning shell
27) nip
28) line of closest approach
29) reservoir of developer
30) developer
31) skive
32) toner replenisher tube
33) return augers a, b
34) screw blades a, b
38) feed augers a, b
40) screw blades a, b
48) central portion of sump
50) first conveyor roller
53) magnetic core
55) rotating shell
59) small magnets
61) skive
63) second conveyor roller
64) magnetic core
65) magnets
66) rotating cylindrical conveyor shell
67) nip
70) nip
72) skive
74) skive
80) second embodiment
81) printer module
82) return auger
84) feed auger
86) metering skive
88) stripping skive
90) third embodiment
92) single conveyor roller
94) metering skive
96) stripping skive
100) paper
120) fuser apparatus

What is claimed is:

1. A developer station for an electrographic printer having a photoconductor member, comprising:

a sump for holding a reservoir of magnetic developer, and a magnetic brush roller mounted above said sump and including a rotatable magnetic core surrounded by a substantially cylindrical rotatable toning shell rotatably mounted with respect to the core, said shell being adjacent to the photoconductor member and defining a nip, wherein a tangent line tangent to the cylindrical toning shell at said nip is oriented within a range of between about +45° and −45° with respect to a vertical line, and said magnetic developer is applied to said toning shell at an angular distance of no more than about 120° from said nip.

2. The developer station of claim 1, wherein said developer station includes at least one conveyor roller that transports developer from said reservoir to a bottom portion of said toning shell.

3. The developer station of claim 2, wherein said at least one conveyor roller includes a bucket assembly that mechanically conveys developer from the sump to said toning shell.

4. The developer station of claim 2, wherein said at least one conveyor roller includes a magnetic core and a rotatably mounted cylindrical conveyor shell concentrically mounted around said magnetic core that magnetically conveys developer, and wherein a magnetic field strength around said conveyor shell is substantially less than a magnetic field of said toning shell where said magnetic developer is applied.

5. The developer station of claim 1, wherein said toning shell is eccentrically mounted and substantially closest to said magnetic core within about +30° and −30° of said nip between said shell and said photoconductor member.

6. The developer station of claim 1, wherein said toning shell is eccentrically mounted with respect to said magnetic core and wherein a magnetic field around said cylindrical toning shell varies between a highest and lowest field strength, and said magnetic developer is applied to a region of said toning shell having a magnetic field strength that is intermediate between said highest and lowest field strength.

7. The developer station of claim 1, wherein said magnetic developer is applied to one of a bottom portion and a top portion of said toning shell.

8. The developer station of claim 1, wherein said toning shell of said magnetic brush developer comes into direct contact with said reservoir of developer in said developer sump such that no conveyor roller is present.

9. The developer station of claim 2, wherein a second conveyor roller receives developer from a first conveyor roller and applies developer to a top portion of the toning shell.

10. A developer station for an electrographic printer having a photoconductor drum, and a horizontally oriented image transport webbing tangent to said drum at one of a 12 o'clock position and a 6 o'clock position, comprising:

a sump of magnetic developer, and a magnetic brush roller mounted above said sump and including a rotatable magnetic core surrounded by a substantially cylindrical toning shell rotatably mounted with respect to the core, said shell being adjacent to the photoconductor drum and defining a nip, wherein a tangent line tangent to the cylindrical toning shell at said nip is oriented within a range of between about +45° and −45° with respect to a vertical line, and said magnetic developer is applied to said toning shell at an angular distance of no more than about 120° from said nip, and said toning shell is substantially closest to said rotatable magnetic core within about +30° and −30° from said nip.

11. The developer station of claim 10, wherein said tangent line is oriented within a range of between about +10° and −10° with respect to a vertical line.

12. The developer station of claim 10, wherein said magnetic developer is applied to said toning shell at an angular distance of no more than about 100° from said nip.

13. The developer station of claim 10, wherein said toning shell is eccentrically mounted and substantially closest to said rotatable magnetic core within about +5° and −5° from said nip.

14. The developer station of claim 10, wherein said toning shell is eccentrically mounted with respect to a magnetic core and a magnetic field around said cylindrical toning shell varies between a highest and lowest field strength, and said magnetic developer is applied to a region of said toning shell having a magnetic field strength that is intermediate between said highest and lowest field strength.

15. The developer station of claim 10, wherein said magnetic developer is applied to one of a bottom portion and a top portion of said toning shell.

16. The developer station of claim 10, wherein said developer station includes at least one conveyor roller that transports developer from a reservoir to a bottom portion of said toning shell.

17. The developer station of claim 16, wherein said at least one conveyor roller includes a bucket assembly that mechanically conveys developer from the sump to said toning shell.

18. The developer station of claim 16, wherein said at least one conveyor roller includes a magnetic core and a rotatably mounted cylindrical conveyor shell concentrically mounted around said magnetic core that magnetically conveys developer, and wherein a magnetic field strength around said conveyor shell is substantially less than a magnetic field of said toning shell where said magnetic developer is applied.

19. The developer station of claim 10, wherein said toning shell of said magnetic brush roller comes into direct contact with said developer in said developer sump thereby obviating the need for a conveyor roller.

20. A method of electrographic printing in a printer having a photoconductor member, and a developer station including a magnetic brush having a rotating magnetic core and a toning shell tangent to the photoconductor member along a line, and a reservoir of developer formed from magnetic carrier particles and toner particles, comprising the steps of:

rotating the magnetic core relative to the toning shell during a printing operation such magnetic carrier particles on the toning shell are subjected to at least about 190 pole flips per second, and delivering developer to the toning shell at an angular distance no more than about 120° from the tangent line between the toning shell and the photoconductor member to reduce a residence time that the developer stays on the toning shell prior to transfer of toner particles from the toning shell to the photoconductor member.

21. The electrographic printing method of claim 20, wherein said toning shell is eccentrically mounted relative to an axis of rotation of said magnetic core.

22. The electrographic printing method of claim 20, wherein said toning shell and said magnetic core are rotated at speeds which permit the photoconductor member to print at a speed of at least about 17 inches per second.

23. The electrographic printing method of claim 20, wherein said toning shell and said magnetic core are rotated at speeds which permit the photoconductor member to print at a speed of at least about 23 inches per second, and which subject the magnetic carrier particles on the toning shell to at least about 270 pole flips per second.

24. The electrographic printing method of claim 20, wherein said toning shell and said magnetic core are rotated at speeds which permit the photoconductor member to print at a speed of at least about 34 inches per second, and which subject the magnetic carrier particles on the toning shell to at least about 400 pole flips per second.

25. The electrographic printing method of claim 20, wherein developer is delivered to the toning shell at an angular distance no more than about 100° from the tangent line between the toning shell and the photoconductor member.

* * * * *